United States Patent [19]

Shinkai et al.

[11] Patent Number: 4,723,405

[45] Date of Patent: Feb. 9, 1988

[54] SPINDLE FOR SPINNING FRAME OR TWISTING MACHINE

[75] Inventors: Kunio Shinkai, Handa; Yutaka Tanaka, Gifu, both of Japan

[73] Assignee: Howa Kogyo Kabushiki Kaisha, Nagoya, Japan

[21] Appl. No.: 888,107

[22] Filed: Jul. 18, 1986

Related U.S. Application Data

[63] Continuation of Ser. No. 679,295, Dec. 7, 1985, abandoned.

[30] Foreign Application Priority Data

Dec. 8, 1983 [JP] Japan ..... 58-232268
Sep. 5, 1984 [JP] Japan ..... 59-186113

[51] Int. Cl.[4] ..... B65H 75/28; D01H 9/00

[52] U.S. Cl. ..... 57/266; 57/299; 242/125.1

[58] Field of Search ..... 57/299, 266, 274, 278, 57/67, 353, 129, 131, 269; 242/125.1, 18 PW, 18 EW

[56] References Cited

U.S. PATENT DOCUMENTS 3,103,779 9/1963 Van Den Berg et al. ..... 57/131 X
3,380,238 4/1968 Araki et al. ..... 242/125.1 X
3,518,823 7/1970 Adams et al. ..... 57/131
3,681,905 8/1972 Furtmeier et al. ..... 57/299
3,778,996 12/1973 Olson et al. ..... 57/269
3,793,818 2/1974 Yamamoto ..... 57/274
3,876,165 4/1975 Comer ..... 242/125.1
3,905,184 9/1975 Takai et al. ..... 57/274

FOREIGN PATENT DOCUMENTS 2076026 11/1981 United Kingdom ..... 57/299

*Primary Examiner*—Stuart S. Levy
*Assistant Examiner*—Joseph J. Hail, III
*Attorney, Agent, or Firm*—Michael N. Meller

[57] ABSTRACT

The present invention relates to a spindle for a spinning frame or a twisting frame by which a tail yarn is formed on a full bobbin and is taken out from the full bobbin at a cop changing operation and is assuredly held on the spindle. In the spindle of the present invention, a band-like yarn-hanging member is arranged on the peripheral face of an intermediate part of a bobbin-attaching portion of the spindle and the band-like yarn-hanging member catches and holds the yarn wound in the form of a loop attached to the spindle at the cop changing operation.

7 Claims, 19 Drawing Figures

SPINDLE FOR SPINNING FRAME OR TWISTING MACHINE

This application is a continuation, of application Ser. No. 679,295, filed 12/7/85 now abandoned.

BACKGROUND OF THE INVENTION

1. Field of the Invention

The present invention relates to a spindle for a spinning frame or a twisting machine. More particularly, the present invention relates to a spindle for a spinning frame or a twisting frame which is operated in such a manner that a tail yarn is formed on a full bobbin and, at the cop changing operation, the tail yarn is taken out from the full bobbin and wound in the form of a loop on the spindle.

2. Description of the Related Art

It is known that in a spinning frame, when a bobbin on a spindle becomes full, the full bobbin is doffed from the spindle and an empty bobbin is donned on the spindle, that is, the so-called cop changing operation is carried out. This cop changing operation has heretofore been manually performed, but recently, automatic cop changing has been adopted as a labor-saving measure. Automatic cop changing is roughly divided into the so-called simultaneous doffing method in which cop changing is carried out simultaneously in all the spindles by a cop changer attached to the spinning frame, and the group doffing method in which a doffer intermittently travels along the front face of the spinning frame and the cop changing operation is conducted sequentially for a predetermined number of spindles.

Nevertheless, whether manual cop changing or automatic cop changing is adopted, the disposal of the tail yarn after cutting is an important problem. More specifically, at the cop changing operation, after a full bobbin is held and doffed from a spindle, the tail yarn extending between the full bobbin and the spindle is cut by an appropriate means, but subsequent winding becomes impossible if the cut tail yarn is not held at a predetermined position (of course, there is a certain allowable range for this position) on the surface of the spindle and the tail yarn is not gripped between an empty bobbin and the spindle when the empty bobbin is donned. To ensure such holding and gripping, there is ordinarily adopted a method in which a barrel winding and tail winding are formed on the full bobbin. By doffing the full bobbin from the spindle, the tail winding is pulled and unwound and is turned on the spindle to form a loop winding on the spindle, and the tail yarn is cut and held at the predetermined position.

However, in the above-mentioned method, since only a slight frictional resistance between the loop winding and the spindle is utilized, detachment of the loop is caused at the time of cutting the tail yarn by the tension imposed on the tail yarn or for other reasons, and therefore, the operation reliability is low and the method is practically non-operative. As a means for overcoming this defect, there is adopted an automatic group doffing method in which a tail yarn wound in a loop is once held by a holding member attached to a doffer and is then cut. In this method, since a special holding device is necessary, the structure becomes complicated and the manufacturing cost is increased. Furthermore, in this method, adjustment of the timings for inserting an empty bobbin and releasing the held tail yarn is very difficult and satisfactory results cannot be obtained.

As pointed out above, a certain countermeasure is taken in the group doffing method, though this countermeasure is still insufficient. However, in the simultaneous doffing method, because of simultaneous doffing of all the bobbins and because of other production limits, attachment of a tail yarn holding device such as mentioned above is substantially impossible. At present, no substantial countermeasure is available, and in the case of manual operation, of course, no means can be adopted.

As the spindle for the manual cop changing operation, a spindle provided with a special cutting device is proposed in Japanese Unexamined Utility Model Publication (Kokai) No. 45-28573. According to this proposal, a chip piece having a peripheral groove is formed in the upper portion of the spindle, and a spiral ring is fitted in this peripheral groove. At the cop changing operation, the yarn wound in a loop is assuredly held in the spiral ring and is cut. However, since the tail yarn intrudes into the spiral ring and is cut, the remaining yarn is always left in the upper portion of the spindle and is accumulated on each spindle, and thus, since the disposal of these remaining yarns is troublesome, the method is not practically carried out.

SUMMARY OF THE INVENTION

It is a primary object of the present invention to solve the above-mentioned problems concerning the disposal of a tail yarn of a full bobbin and provide a spindle in which a tail yarn is securely held at the cop changing operation and the spinning operation is smoothly performed after the cop changing operation and the remaining yarns on the spindle can be easily removed, and which is applicable to either the manual cop changing method or the simultaneous or group doffing method.

In accordance with the present invention, this object can be attained by a spindle for a spinning frame or a twisting machine, which comprises a band-like yarn-hanging member attached to a bobbin-attaching portion of the spindle to hang a loop-wound yarn thereon.

It is preferred that this yarn-hanging member be arranged in a band-like form between the middle point of the bobbin-attaching portion of the spindle and the point of first contact of the loop-wound yarn with the spindle. If the yarn-hanging member is thus arranged, even in the case of automatic cop changing, the tail yarn is securely held and the disposal of the remaining yarn is facilitated.

This yarn-hanging member may be constructed by fitting or bonding a raised fabric having many needle-like or loopy piles formed thereon to the spindle or by forming many projections on the surface of the spindle by knurling or scratch-brush finishing.

BRIEF DESCRIPTION OF THE DRAWINGS

The present invention wil now be described in detail with reference to preferred embodiments illustrated in the accompanying drawings, in which.

DESCRIPTION OF THE PREFERRED EMBODIMENTS

As pointed out hereinbefore, automatic cop changing is roughly divided into the simultaneous doffing method and the group doffing method. Various spindles differing in structure are adopted in the simultaneous doffing method and the group doffing method. Whatever type of spindles are used, the principle of operation comprises removing (doffing) full bobbins from spindles (simultaneously from all the spindles or repeatedly from groups of spindles), cutting out tail yarns of the doffed full bobbins, and donning empty bobbins on the spindles, from which the full bobbins have been removed, to effect cop changing. Accordingly, the present invention will now be described with reference to embodiments wherein the present invention is applied to simultaneous cop changing with no means for preventing the detachment of loops.

Figure 1:
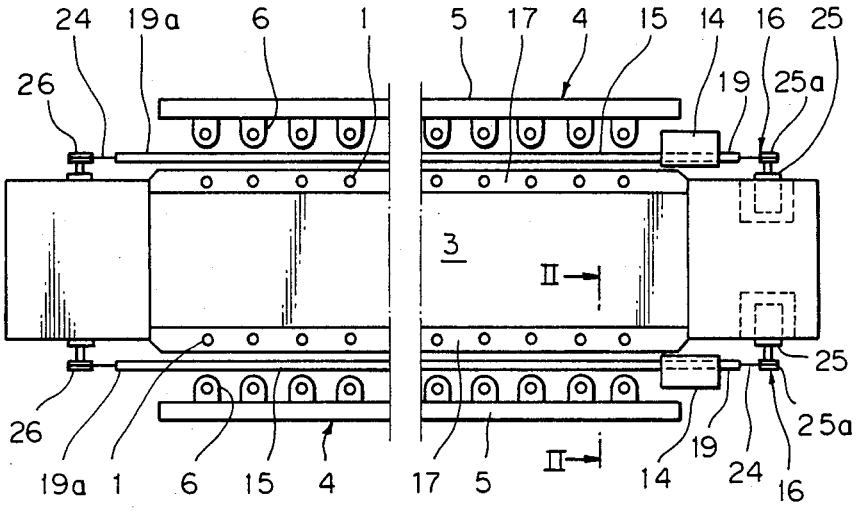
FIG. 1 is a schematic plane view showing a spinning frame to which the spindle of the present invention is applied.
Figure 2:
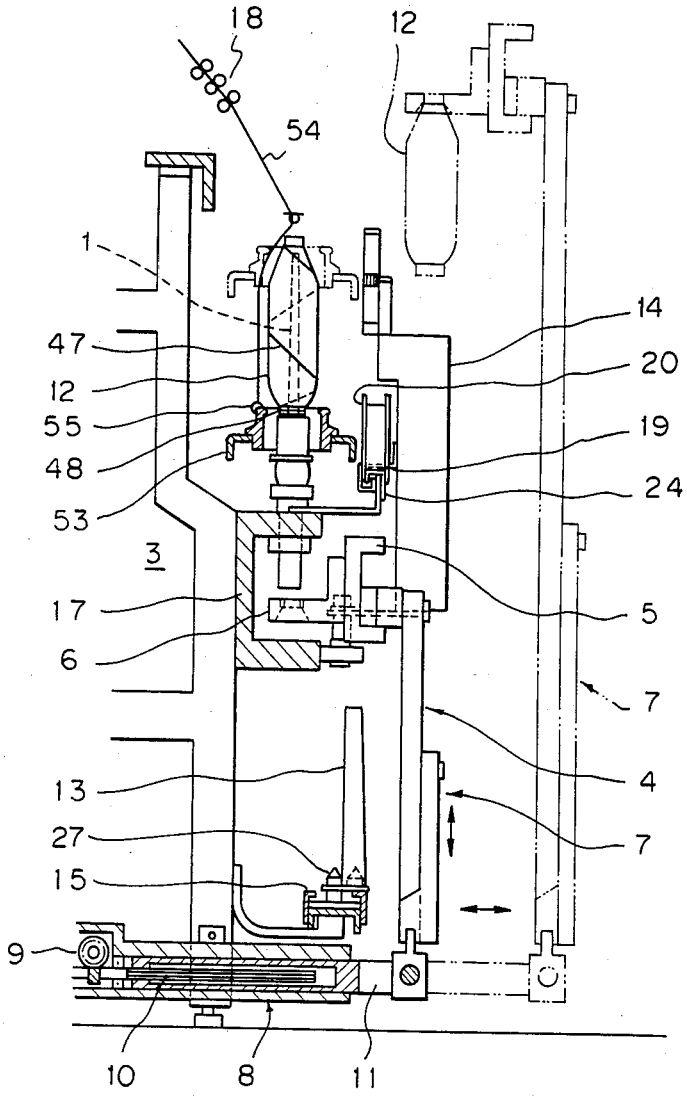
FIG. 2 is an enlarged view showing the section taken along the line II—II in FIG. 1.

In FIGS. 1 and 2, reference numeral 3 represents a spinning frame, and a simultaneous cop changing device 4 described below is attached to the spinning frame 3. Many bobbin holding members 6 are attached to a doffing bar 5, and the number of bobbin holding members 6 corresponds to the number of spindles 1 of the spinning frame 3. A predetermined vertical movement is given to the bobbin holding members 6 by a vertical movement device 7 according to the Scott-Russell strict linear movement mechanism, and the vertical movement device 7 is connected to a horizontal movement device 8. As shown in the drawings, in the horizontal movement device 8, a screw lever 10 rotated by a screw gear 9 is screwed to a main shaft 11, and the vertical movement device 7 is attached to the main shaft 11. Accordingly, the main shaft 11 is advanced and retreated by forward and reverse rotations of the screw gear 9, and the vertical movement device 7 moves forward and backward to respectively approach the spinning frame 3 and separate therefrom. Accordingly, the doffing bar 5 makes vertical and horizontal movements in a predetermined sequence along a predetermined locus, and the bobbin holding members 6 hold full bobbins 12 and empty bobbins 13, whereby full bobbins are exchanged with empty bobbins on all the spindles to effect cop changing.

In the foregoing embodiment, the Scott-Russell strict linear movement mechanism is adopted for the vertical movement device 7 and the screw gear 9 is used for the horizontal movement mechanism 8. However, the movement devices 7 and 8 are not limited to the above-mentioned devices, and other mechanisms may be adopted insofar as predetermined vertical and horizontal movements can be given to the doffing bar 5. Moreover, the doffing bar 5 may be moved forward and backward by the swinging operation.

A tail yarn cutting device 14 is disposed to cut a tail yarn extended between the spindle 1 and the full bobbin 12 while the full bobbin 12 being doffed from the spindle 1 is transferred to a cop holding device 15 attached to the spinning frame 3. The structure of this tail yarn cutting device 14 will now be described.

As shown in FIG. 1, the tail yarn cutting device 14 is arranged so that it can be moved left and right on a guide rail 19 laid out along the front face of the spinning frame 3 through a guide roller 20 and by a driving device 16. The driving device 16 comprises a motor 25 for forward and reverse rotations arranged on the left or right end of the spinning frame 3, a pulley 26 attached to the other end of the spinning frame 3, and a belt 24 hung between the pulley 26 and a pulley 25*a* connected to the motor 25. The tail yarn cutting device 14 is connected to the belt 24 by way of a connecting plate 39 (see FIG. 4), and the tail yarn cutting device 14 is moved in the above-mentioned manner by forward and reverse rotations of the motor 25. Cutters 34 and 34*a* each having a rotary blade are arranged in the tail yarn cutting device 14, and as described in detail hereinafter, the cutters 34 and 34*a* are coupled to turn with movement of the tail yarn cutting device 14 and the tail yarn 51 extended between the spindle 1 and the full bobbin 12 is thereby cut.

Figure 3:
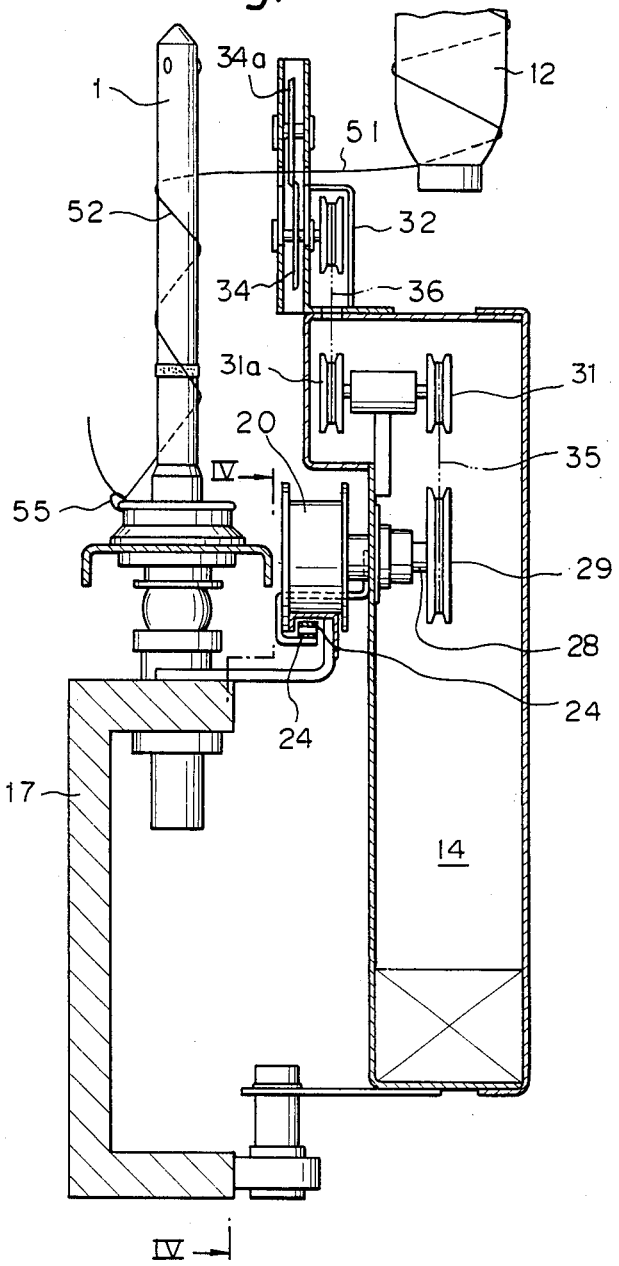
FIG. 3 is an enlarged view showing a main part of the spinning frame to which the spindle of the present invention is applied, which illustrates the state where a full bobbin is taken out from the spindle.
Figure 4:
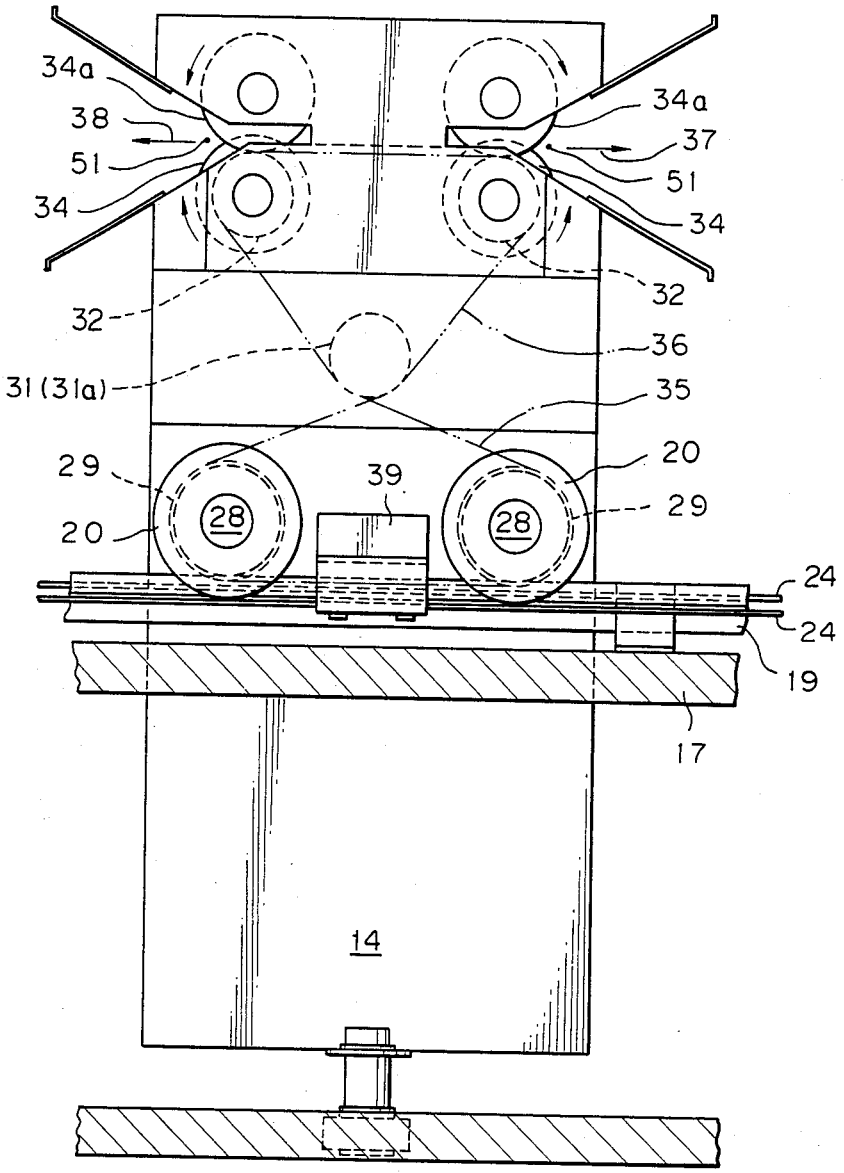
FIG. 4 is a view showing the section taken along the line IV—IV in FIG. 3.

The structure and operation of the tail yarn cutting device 14 wil now be described with reference to FIGS. 3 and 4. The rotation of the guide roller 20 while travelling on the guide rail 19 is transmitted to a V-pulley 29 through a shaft 28. As shown in FIGS. 3 and 4, a belt 35 is hung between two V-pulleys 29 and an intermediate roller 31, and a belt 36 is hung between an intermediate pulley 31*a* coaxial with the intermediate pulley 31 and two V-pulleys 32 coaxial with a circular cutter 34. Accordingly, when the motor 25 is rotated in the forward direction and the tail yarn cutting device 14 is pulled by the belt 24 and travels in the direction of arrow 37 in FIG. 4, the cutter 34 arranged on the right side is turned in the direction of the arrow and the cutter 34*a* pressed to the cutter 34 is turned in the opposite direction by friction with the cutter 34, whereby the tail yarn 51 in contact with the cutters 34 and 34*a* is held of the crossing point of the cutters 34 and 34*a* and is cut. When the motor 25 is rotated in the reverse direction and the tail yarn cutting device 14 travels in the direction opposite to the above-mentioned direction, that is, in the direction of arrow 38, the rotation direction of the cutters 34 and 34*a* arranged on the left side is as indicated by the arrows in FIG. 4, and the tail yarn 51 is similarly cut. The rotation speed of the cutters 34 and 34*a* can be adjusted to an optimum level by changing the diameter ratio among the V-pulleys 29 and 32 and the intermediate pulleys 31 and 31*a*, whereby optimum cutting conditions can be obtained.

The gist of the present invention does not reside in the above-mentioned cop changing device 4 or tail yarn cutting device 14. Accordingly, any of the simultaneous and group cop changing devices can be used, insofar as full bobbins are exchanged with empty bobbins, and any tail yarn cutting device may be used, insofar as the tail yarn 51 extended between the full bobbin 12 and the spindle 1 is cut. In short, any mechanism can be utilized if the above functions are performed.

Figure 5:
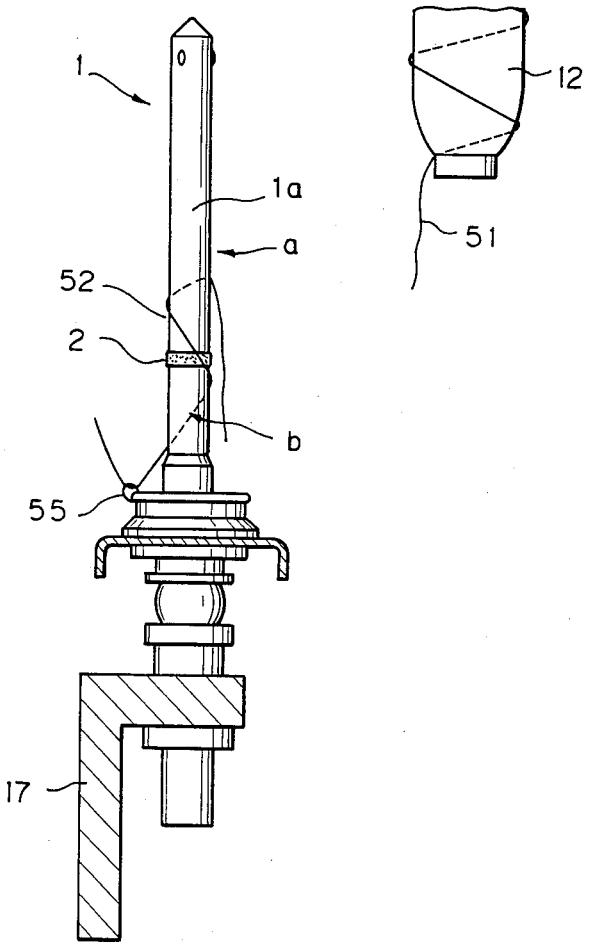
FIG. 5 is a partially omitted side view showing the cutting state of a tail yarn on the spindle of the present invention.
Figure 6:
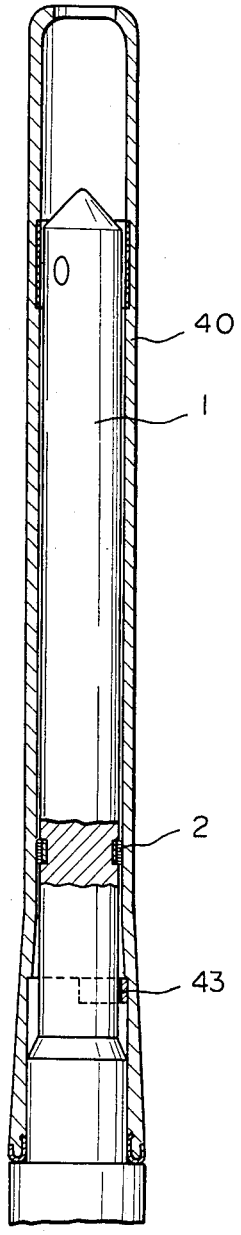
FIG. 6 is a sectional view illustrating the state where a bobbin is set on the spindle of the present invention.

The spindle 1 of the present invention will now be described. As shown in FIGS. 3, 5, 6 and 7, the spindle 1 of the present invention comprises a yarn hanging member 2 arranged at the intermediate part of a bobbin-attaching portion 1*a* of the spindle 1. It is preferred that the yarn-hanging member 2 be arranged between the middle point (the point indicated by an arrow a in FIG. 5) of the bobbin-attaching portion of the spindle 1 and the point of the first contact of the loop-wound yarn 52 with the spindle 1 (the point indicated by an arrow b in FIG. 5), as shown in FIG. 5, and it also is preferred that the yarn-hanging member 2 be arranged in the band-like form on the peripheral surface of the spindle 1.

Figure 7:
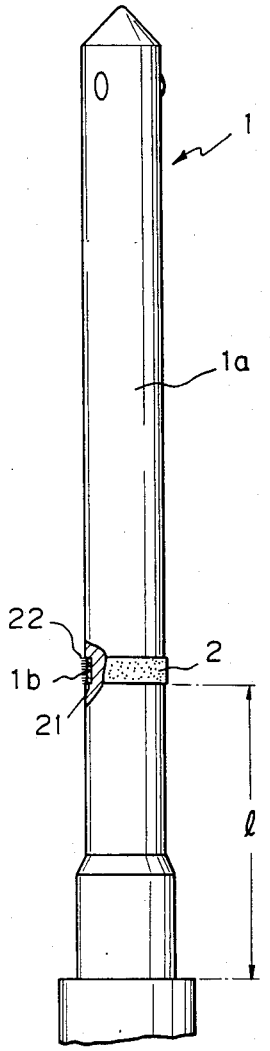
FIG. 7 is a partially sectional front view illustrating the spindle of the present invention.

One preferred example of the yarn-hanging member 2 is shown in FIG. 7. In the case of an 8-inch lift spindle, as shown in FIG. 7, an annular groove 1*b* having a depth of 1 mm and a width of 5 mm is formed at a point 60 mm above the lower end of a bobbin 40 (see FIG. 6) to be attached, and a raised fabric formed by electro-implanting nylon piles 22 (the pile length is 1 mm) on the surface of an annular band 21 of a urethane rubber having a width of 5 mm and a thickness of 0.7 mm is preferably embedded in the annular groove 1*b*. In this case, electro-implanted nylon piles 22 are projected along a length of 0.7 mm from the surface of the spindle 1. Accordingly, the raised fabric can be firmly held at the predetermined attachment position only by fitting it in the annular groove 1*b*, and attachment and detachment of the raised fabric are very easy. Thus, use of this raised fabric as the yarn-hanging member is preferred from the practical viewpoint. When nylon piles are worn, for example, through long-time use of the raised fabric, repairing or replacement can be easily accomplished. The raised fabric, having many needle-like or loopy piles 22 formed on the surface thereof, is not limited to the above-mentioned example, but a product marketed under the tradename "Magic Fastener", a velvet fabric, an electro-implanted fluffy fabric and a short-hair brush may be used to carry out the yarn-hanging function.

Figure 10A:
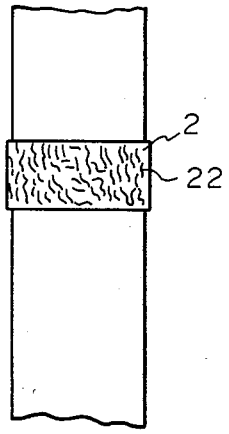
FIG. 10 is an enlarged front view showing examples of the yarn holding means, in which A shows a raised fabric, B shows projections formed by knurling processing and C shows projections formed by satinizing processing.
Figure 10B:
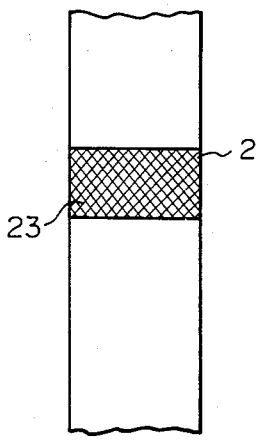
Figure 10C:
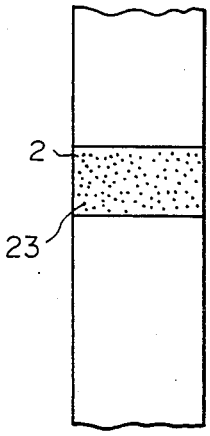

Other examples of the yarn-hanging member 2 are illustrated in FIG. 10. FIG. 10A shows a raised fabric bonded to the spindle 1, FIG. 10B shows projections 23 formed on the peripheral face of the spindle by a knurling process, and FIG. 10C shows projections 23 formed on the peripheral face of the spindle by scratch-brush finishing. In each of these examples, when the tail yarn 51 is cut, the yarn-hanging member 2 securely catches and holds the loop-wound yarn 52 turned on the spindle to prevent detachment of the loop. Insofar as this function is carried out, the structure and material of the yarn-hanging member are not particularly critical.

Figure 8:
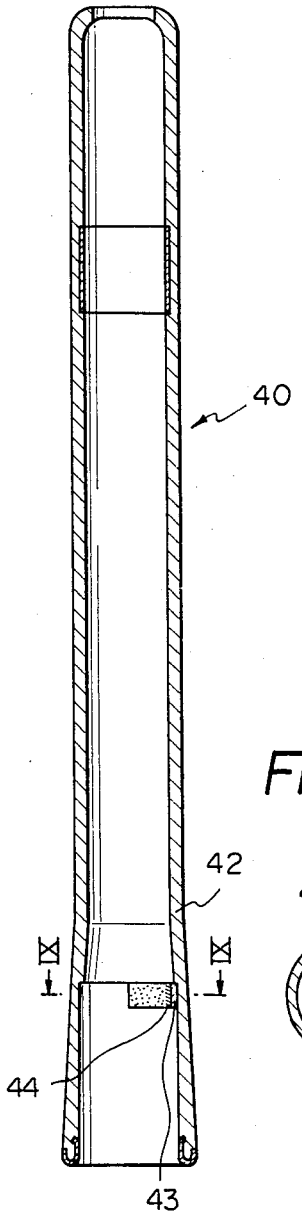
FIG. 8 is a view showing the longitudinal section of a bobbin preferably used for the spindle of the present invention.
Figure 9:
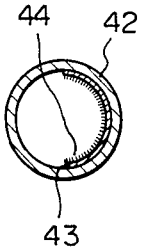
FIG. 9 is a view showing the cross section taken along the line IX—IX in FIG. 8.

As pointed out hereinbefore, the disposal of the remaining yarn left on the spindle at the cop changing operation is a serious practical problem. An example of the bobbin preferably used in the present invention for solving this problem will now be described with reference to FIGS. 8 and 9. A raised fabric 43 is attached along about ½ of the inner circumferential face of a lower portion 42 of the body of this bobbin 40. Namely, this raised fabric 43 is located below the yarn-hanging member 2 of the spindle 1 when the bobbin 40 is mounted on the spindle 1 (see FIG. 6). It is preferred that fluffs 44 of the raised fabric 43 be implanted obliquely upward, so that the loop-wound yarn 52 held on the yarn-hanging member 2 will not be detached when an empty bobbin 40 is donned the spindle, and so that when a full bobbin is doffed from the spindle, the remaining yarn on the yarn-hanging member 2 is caught by the raised fabric 43 and is carried away by the raised fabric 43.

The operation of the present invention will now be described. During the operation of the spinning frame 3, as shown in FIG. 1, the tail yarn cutting device 14 stands by at a left or right stand-by position 19*b* of the guide rail 19. When a bobbin becomes full, the ring rail 53 is vertically moved between positions indicated by solid and imaginary lines shown in FIG. 2, and barrel winding 47 and tail winding 48 and effected on the full bobbin 12. Then, the spinning frame 3 is stopped and the simultaneous cop changing device 4 is actuated to effect cop changing.

Figure 11A:
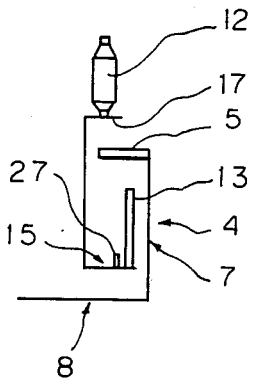
FIGS. 11*a*–11*g* are diagrams illustrating the simultaneous cop changing operations in a spinning frame provided with the spindle of the present invention.
Figure 11B:
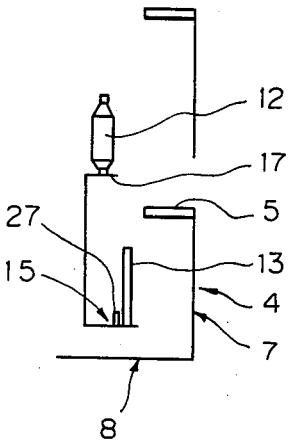
Figure 11C:
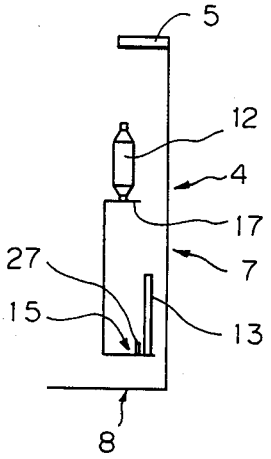
Figure 11D:
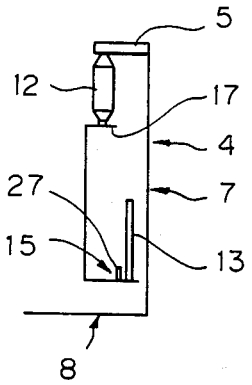

Simultaneous cop changing is first described with reference to the operation diagram of FIG. 11. FIG. 11*a* shows the stand-by position of the simultaneous cop changing device 4. At this point, the doffing bar 5 is intruded below the spindle rail 17 and is operated in the following sequence. First, the horizontal movement device 8 is operated to withdraw the doffing bar 5 as shown in FIG. 11*b* to a position where the doffing bar 5 does not interfere with the spindle rail 17. Then, by operation of the vertical movement device 7, the doffing bar 5 is raised to the topmost position indicated by an imaginary line in FIG. 11*b*, and the doffing bar 5 (correctly, the cop holding device) is advanced to the point just above the full bobbin 12 on the spindle 1, as shown in FIG. 11*c*. Then, as shown in FIG. 11*d*, the doffing bar 5 is lowered to hold the full bobbin 12 and then elevated to doff the full bobbin 12 from the spindle 1. At this point, the remaining yarn left in the form of a loop on the spindle 1 is caught and carried away by the raised fabric 43 of the bobbin. When the doffing bar 5 reaches the topmost position shown in FIG. 11*e* and the full bobbin 12 is doffed from the spindle 1, the tail yarn 51 is released from the tail winding 48 formed on the full bobbin 12 and this tail yarn 51 is spirally wound on the spindle 1 to form a loop winding 52, as shown in FIG. 3, while the remaining tail yarn 51 is extended between the spindle 1 and the full bobbin 12. Since the yarn-hanging member 2 described hereinbefore, such as the raised fabric, is attached to the surface of the spindle 1 of the present invention, if the tail yarn 51 is wound on the spindle 1 as the loop winding 52, the wound yarn is caught in the raised piles or fluffs of the yarn-hanging member 2 and is positively and assuredly held and secured on the surface of the spindle 1 (the surface of the yarn-hanging member 2). This positive holding of the loop winding 52 by the yarn-hanging member 2 is quite different from bare holding of the loop winding 52 by fluffs of the yarn 52 loop-wound on the spindle 1 according to the conventional technique. Namely, this positive holding according to the present invention is distinguishable over the conventional negative holding in that the loop winding is caught and held in the state where fluffs of the loop winding 52 are entangled with the yarn-hanging member 2 and a positive holding effect can be attained similar to that which is realizable by any holding means.

Figure 11E:
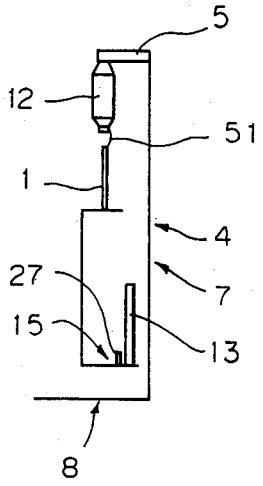
Figure 11F:
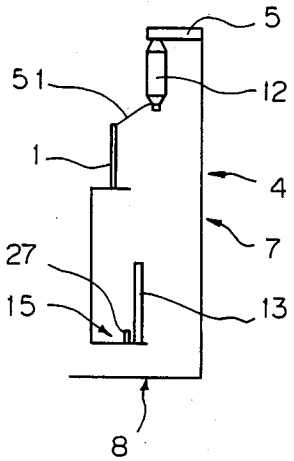
Figure 11G:
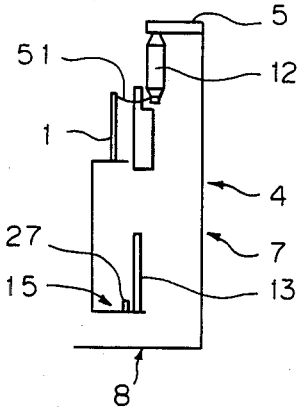

After the loop winding 52 has been formed and held on the yarn-hanging member 2 in the above-mentioned manner as shown in FIG. 11*e*, the doffing bar 5 passes through the state shown in FIG. 11*f* and reaches the position shown in FIG. 11*g* (FIG. 3), and at this position, the tail yarn 51 extended between the spindle 1 and the full bobbin 12 is cut. Cutting of the tail yarn 51 may be effected appropriately at any point before the full bobbin 12 doffed from the spindle 1 is donned on the peg 27 of the cop holding device 15, but it is especially preferred that cutting be effected at the position shown in FIG. 11*g*.

When the doffing bar 5 reaches the position shown in FIG. 11*g* (FIG. 3), lowering of the doffing bar 5 is stopped or the lowering speed is reduced, and if a forward rotation signal is transmitted to the motor 25 of the driving device 16 and the motor 25 is rotated in the forward direction, the tail yarn cutting device 14 travels on the guide rail 19 from one stand-by position **19*b* to the other stand-by position 19*a*, and by this rotary travel, the cutters 34 and 34*a* are turned to cut the tail yarn 51 extended between the spindle 1 and the full bobbin 12. Since the loop winding 52 around the spindle 1 is caught and held on the yarn-hanging member 2 in the above-mentioned manner, detachment of the loop is not caused even if cutting of the tail yarn is effected, but rather the loop is held on the surface of the spindle 1 as shown in FIG. 5. Cutting of the tail yarn 51** at the position shown in FIG. 11*g* (FIG. 5) is most preferred because no tension is imposed on the tail yarn 51 extended between the spindle 1 and the full bobbin 12. However, even if a tension is imposed for a certain reason or the tail yarn 51 is cut at a position other than the position shown in FIG. 11*g*, where a tension is imposed on the tail yarn 51 and the tail yarn 51 is rapidly returned toward the spindle 1, since the yarn hanging member 2 is arranged below the middle point of the bobbin-attaching portion of the spindle 1, the vibrating force on the yarn end due to the above-mentioned return force is weakened by turning the loop winding on the spindle, and detachment of the loop from the yarn-hanging member 2 is not caused but rather the loop is held on the spindle 1, as shown in FIG. 5. The tail yarn cutting device 14, which has thus completed the tail yarn cutting operation, reaches the stand-by position **19*a* and stands by for the subsequent cutting operation. The doffing bar 5 is brought down to don the held full bobbin 12 on the peg 27 of the cop holding device 15, and a prepared empty bobbin 13 is delivered and held on the doffing bar 5 and is then attached to the spindle 1. Since the loop winding 52 around the spindle 1 is caught and held on the surface of the spindle 1 in the above-mentioned manner, the spun yarn 54 extended from the spindle 1 to the drafting part 18 through the traveller 55 is firmly gripped between the empty bobbin 13 and the spindle 1** and subsequent winding becomes possible.

In the case where cop changing is manually carried out, even if the yarn connected to the tail yarn between the spindle and the full bobbin 12 is cut before the empty bobbin 13 is attached to the spindle 1 after removal of the full bobbin 12 from the spindle 1, since the loop-wound yarn 52 is caught and held on the yarn-hanging member 2, the yarn is firmly gripped between the empty bobbin 13 and the spindle 1. Accordingly, when the spindle of the present invention is used, the cop changing operation can be performed with only one hand and the cop changing operation can be accomplished more promptly than according to the conventional technique.

Since the spindle of the present invention has the above-mentioned structure, the disposal of the tail yarn, which has been the most serious problem in the cop changing operation in the spinning frame, can be remarkably facilitated and the defect of impossibility of winding after attachment of an empty bobbin, which is often observed in the conventional technique, is eliminated. Accordingly, if the spindle of the present invention is employed, the operation efficiency is improved, and the spindle of the present invention is applicable to all of the manual and automatic cop changing methods. Therefore, the spindle of the present invention is very valuable from the industrial viewpoint.

We claim:

1. An apparatus for automatically doffing a full bobbin of wound yarn and donning an empty bobbin on a spindle in place of said doffed full bobbin in a spinning frame, comprising means for doffing said full bobbin and donning said empty bobbin, and means for cutting a tail winding extending between said spindle and said doffed full bobbin, and said spindle including a yarn holding means for holding a loop-wound yarn portion connected to said tail winding such that said loop-wound yarn remains attached to said spindle after said tail winding is cut, and said yarn holding means being a raised fabric comprising a narrow band-liked substrate and many needle-like or loopy piles formed on the surface thereof, and arranged on the peripheral face of an intermediate part of a bobbin-attaching portion of the spindle, wherein each bobbin includes means for disengaging said loop-wound yarn during doffing of said full bobbin, said disengaging means being a raised fabric formed in a state of inclining upward and arranged along about half of the inner circumference of each bobbin.

2. A method for automatically doffing a full bobbin of wound yarn and donning an empty bobbin on a spindle in place of said doffed full bobbin in a spinning frame, said spinning frame including bobbin doffing and donning means and tail yarn cutting means, and said spindle have a yarn holding means mounted thereon and constituted with a raised fabric, comprising the steps of:

(a) performing a barrel winding in which a yarn is wound in a loop-like shape on a circumference of the full bobbin and a tail winding in which the yarn is successively wound in a ring-like shape on a circumference of a lowermost portion of the full bobbin to make a tail yarn by a rotation of the spindle and moving downward a spindle rail of said spinning frame while said spinning frame is running;

(b) stopping said spinning frame;

(c) looping said tail yarn of said wound yarn around said spindle to form a loop-wound yarn as said full bobbin is being doffed such that said tail yarn catches on the raised fabric of said yarn holding means during looping;

(d) cutting said tail yarn in a substantially tension-free state by contacting and activating said tail yarn cutting means on a portion of said tail yarn arranged between the spindle and the full bobbin;

(e) donning said empty bobbin by coupling said bobbin doffing and donning means to said empty bobbin, so that said tail yarn wound around said spindle is nipped between said spindle and an inside face of a bottom end portion of said empty bobbin, and (f) disengaging said loop-wound yarn from said yarn holding means by catching said loop-wound yarn on a raised fabric attached to an inner circumferential face of said full bobbin.

3. The method of claim 2, further comprising the step of arranging said doffed full bobbin such that the tail winding extends between said spindle and said full bobbin with slack.

4. An apparatus for automatically doffing a full bobbin of wound yarn and donning an empty bobbin on a spindle in place of said doffed full bobbin in a spinning frame, comprising means for doffing said full bobbin and donning said empty bobbin, and means for cutting a tail winding extending between said spindle and said doffed full bobbin, and said spindle including a yarn holding means for holding a loop-wound yarn portion connected to said tail winding such that said loop-wound yarn remains attached to said spindle after said tail winding is cut, and said yarn holding means being a raised fabric comprising a narrow band-like substrate and many needle-like or loopy piles formed on the surface thereof, and arranged on the peripheral face of an intermediate part of a bobbin-attaching portion of the spindle, wherein each bobbin includes means for disengaging said loop-wound yarn during doffing of said full bobbin, said disengaging means being arranged along an inner circumference of each bobbin and comprising a raised fabric.

5. The apparatus of claim 4, wherein the yarn holding means is disposed between the middle part of the bobbin-attaching portion of the spindle and the point of the first contact of the loop-wound yarn with the bobbin-attaching portion of the spindle.

6. The apparatus of claim 4, wherein the piles of said raised fabric in said yarn holding means are formed by electro-implanting.

7. The apparatus of claim 4, wherein an annular groove is formed on the peripheral face of the bobbin-attaching portion of the spindle, the band-like substrate of the raised fabric of said yarn holding means is made from an elastic material such as rubber in the form of a ring, and said band-like substrate of the raised fabric is fitted in said annular groove so that the top ends of the piles project from said annular groove.

* * * * *